US010368649B2

(12) United States Patent
Cohen

(10) Patent No.: US 10,368,649 B2
(45) Date of Patent: Aug. 6, 2019

(54) FOLDING CHAIR ARMREST WITH INTEGRATED BOTTLE OPENER

(71) Applicant: Rio Brands, LLC, W. Conshohocken, PA (US)

(72) Inventor: Warren Cohen, W. Conshohocken, PA (US)

(73) Assignee: Rio Brands, LLC, West Conshohocken, PA (US)

( * ) Notice: Subject to any disclaimer, the term of this patent is extended or adjusted under 35 U.S.C. 154(b) by 120 days.

(21) Appl. No.: 15/813,147

(22) Filed: Nov. 14, 2017

(65) Prior Publication Data

US 2019/0142170 A1 May 16, 2019

(51) Int. Cl.

| | |
|---|---|
| ***A47C 7/62*** | (2006.01) |
| ***B67B 7/16*** | (2006.01) |
| *A47C 4/00* | (2006.01) |

(52) U.S. Cl.

CPC ..... *A47C 7/62* (2013.01); *B67B 7/16* (2013.01); *A47C 4/00* (2013.01)

(58) Field of Classification Search

None

See application file for complete search history.

(56) References Cited

U.S. PATENT DOCUMENTS

| | | | | |
|---|---|---|---|---|
| 2,677,980 | A * | 5/1954 | Dika | B67B 7/16 81/3.27 |
| 3,233,940 | A | 2/1966 | Tooley, Jr. | |
| 4,252,371 | A * | 2/1981 | Lehnen | A47C 5/10 297/27 |
| 4,335,814 | A * | 6/1982 | Benning | B65D 71/0003 206/198 |
| D338,791 | S | 8/1993 | Cohen | |
| D376,060 | S | 12/1996 | Cohen | |
| 7,249,799 | B2 | 7/2007 | Luce | |
| 8,091,962 | B2 | 1/2012 | Quinn | |
| 8,864,222 | B2 * | 10/2014 | Grace | A47C 4/286 297/35 |
| 9,314,390 | B2 | 4/2016 | Hernandez | |
| 9,359,180 | B1 * | 6/2016 | Visconti | B67B 7/16 |
| 2008/0232089 | A1 * | 9/2008 | Riccardi | H04M 1/04 362/88 |

(Continued)

FOREIGN PATENT DOCUMENTS

| | | | |
|---|---|---|---|
| CN | 202588950 U | * | 12/2012 |
| CN | 107673297 A | * | 2/2018 |

*Primary Examiner* — David E Allred

(74) *Attorney, Agent, or Firm* — LaMorte & Associates, P.C.

(57) ABSTRACT

An armrest assembly for use on a folding chair. The armrest assembly has a molded plastic body with a top surface and an underside. A leg joint receptacle is present on the underside of the molded plastic body. The leg joint receptacle has two parallel walls, wherein a leg joint from the folding chair is received between the two parallel walls. A bottle opener is provided. The bottle opener has a base and a head section that extends from the base. The base is mounted to the underside of the molded plastic body, wherein the base directly contacts a wall of the leg joint receptacle. The wall of the leg joint receptacle reinforces the bottle opener, therein accommodating the significant forces that are transferred through the bottle opener when the bottle opener is used to open a bottle.

13 Claims, 5 Drawing Sheets

(56) References Cited

U.S. PATENT DOCUMENTS

| | | | | |
|---|---|---|---|---|
| 2016/0100688 | A1* | 4/2016 | Grace | A47C 4/286<br>297/17 |
| 2016/0363365 | A1* | 12/2016 | Curtis | F25D 23/04 |
| 2017/0015539 | A1* | 1/2017 | Cuddy | B67B 7/162 |

* cited by examiner

FOLDING CHAIR ARMREST WITH INTEGRATED BOTTLE OPENER

BACKGROUND OF THE INVENTION

1. Field of the Invention

In general, the present invention relates to the structure of the armrests that are used on folding chairs, collapsible chairs, camp chairs, beach chairs and other portable lightweight chairs. More particularly, the present invention relates to armrests that are specifically designed to support the presence and operation of a bottle opener.

2. Prior Art Description

There exist many different styles and models of collapsible chairs that are intended to be carried by a user. In addition to be being foldable or collapsible, such chairs are made to be as lightweight as possible while still being functionally sound. In this manner, the chair is not burdensome to carry. Such chairs are often brought to the beach, to tailgates, to concerts and to other such locations that require a chair to be carried a significant distance.

In order to make a chair lightweight, a folding chair is typically manufactured with minimalistic armrests. Often the armrests are little more than strips of fabric or thin moldings of lightweight plastic. The armrests are strong enough to support the weight of an arm, however, the armrests have little integrity to serve any other purpose. Auxiliary items, such as cup holders and phone holders can be attached to the armrests because such items apply very small loads to the armrests. However, items such as bottle openers cannot be attached to the armrests because the torque forces experienced by the bottle opener during use surpass the structural integrity of the armrest. Consequently, if a bottle opener were attached to the lightweight armrest of a portable chair, the armrest would twist, bend or otherwise break as forces are applied to the armrest through the use of the bottle opener.

Bottle openers are useful at the beach, tailgates, concerts, and other places where portable chairs are often carried. However, since the structure of most portable chairs prohibits the use of mounted bottle openers, handheld bottle openers must be used. Handheld bottle openers require the use of two hands, wherein one hand holds the bottle and the other hand manipulates the bottle opener. If a manufacturer wants to sell a folding portable chair together with a bottle opener, a handheld bottle opener is tethered to some aspect of the chair, such as at the end of a zipper head or a pocket flap.

There are many models and styles of portable chairs. There are also a great many models and styles of bottle openers. Accordingly, there have undoubtedly been instances where a person has attempted to mount a bottle opener to the armrest of a portable chair as a matter of convenience. If a user were to find a position on an armrest that is strong enough to mount a bottle opener, that position would typically leave the bottle opener in an exposed position on the armrest. When a portable chair is folded, unfolded and carried, the armrests are often inadvertently contacted by fingers, rings, buttons, clasps, buckles and a variety of other such objects. If a bottle opener were exposed on the armrest of the chair, any one of these objects could easily become caught or entangled in the head of the bottle opener. An exposed bottle opener is, therefore, a danger and a liability that deters chair manufacturers from attempting to design bottle openers into their chair designs.

A need therefore exists for an armrest for a lightweight folding chair that is specifically designed to support an integrated bottle opener, wherein the armrest is not damaged by the use of the bottle opener and the bottle opener is safely positioned to avoid entanglement hazards. These needs are met by the present invention as described and claimed below.

SUMMARY OF THE INVENTION

The present invention is an armrest assembly for use on a lightweight folding chair or collapsible chair. The armrest assembly has a molded plastic body with a top surface upon which a person's arm rests. The molded plastic body has an underside that is honeycombed and reinforced by support ribs for strength.

A leg joint receptacle is present on the underside of the molded plastic body. The leg joint receptacle has two parallel walls, wherein a leg joint from the folding chair is received between the two parallel walls. The parallel walls are made strong so as to accommodate the forces applied by the leg joint of the folding chair.

A bottle opener is provided. The bottle opener has a base and a head section that extends from the base. The base is mounted to the underside of the molded plastic body, wherein the base directly contacts a wall of the leg joint receptacle. The wall of the leg joint receptacle reinforces the bottle opener, therein accommodating the significant forces that are transferred through the bottle opener when the bottle opener is used to open a bottle.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention armrest assembly can be adapted for use in many styles and models of folding chairs, the armrest assembly is shown in only two examples. The exemplary embodiments are selected in order to set forth some of the best modes contemplated for the invention. The illustrated embodiments, however, are merely exemplary and should not be considered limitations when interpreting the scope of the appended claims.

Figure 1:
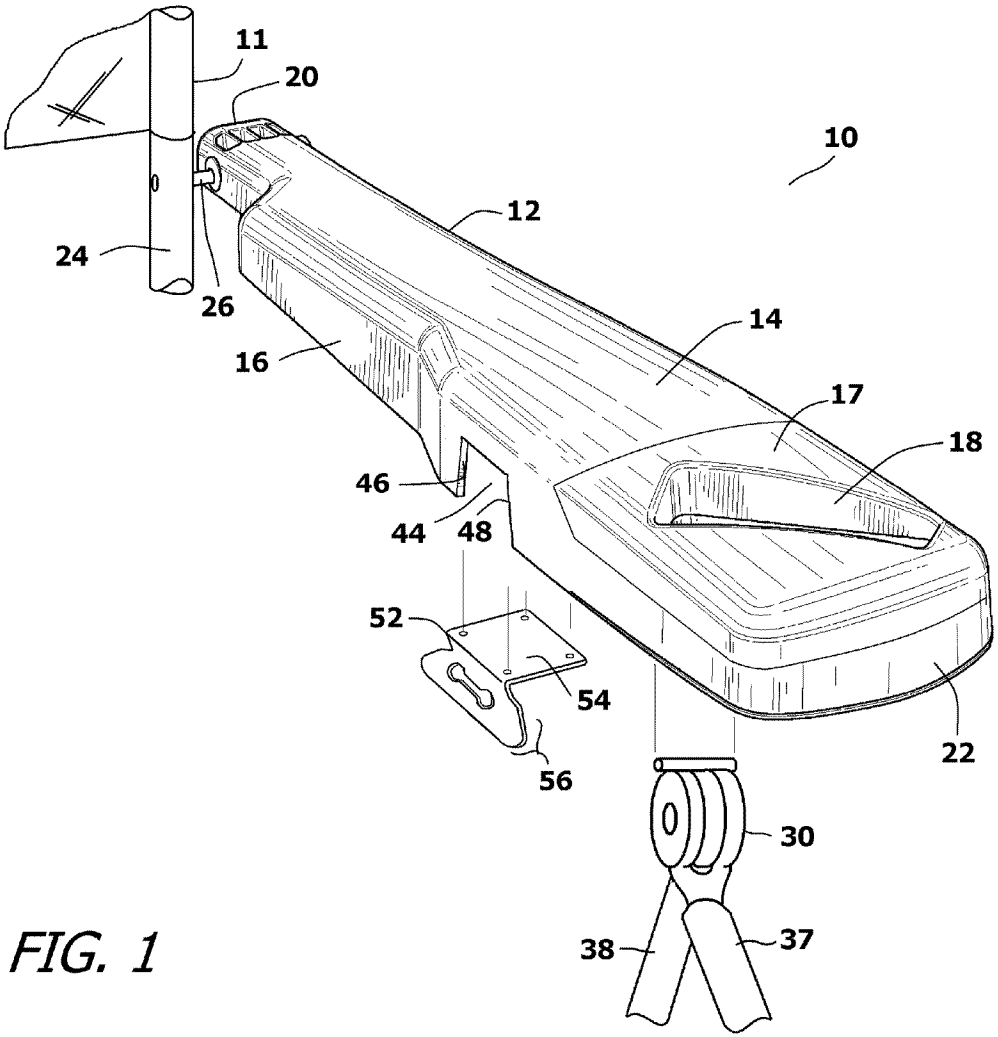
FIG. 1 is a perspective view of an exemplary embodiment of an armrest assembly with the bottle opener shown detached.
Figure 2:
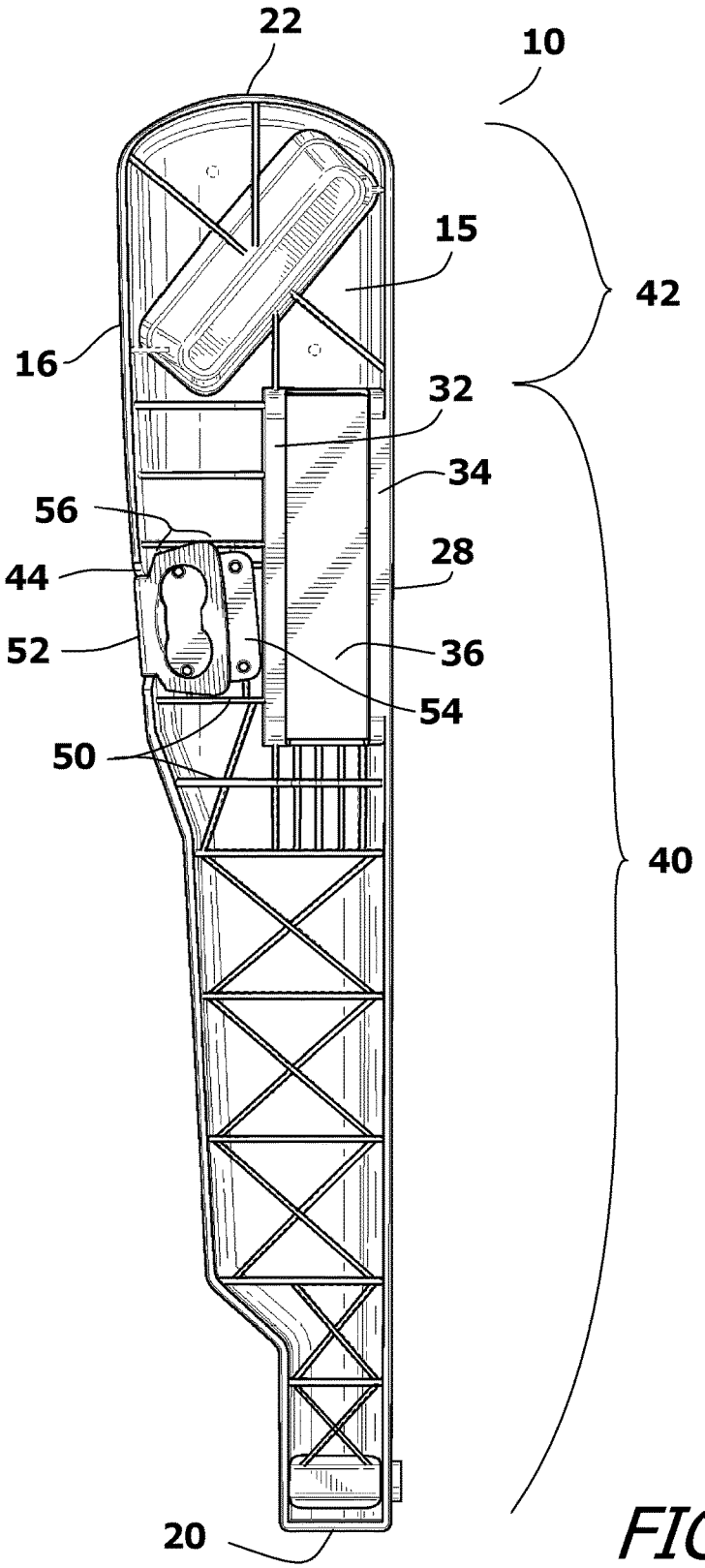
FIG. 2 is a bottom view of the exemplary embodiment of the armrest assembly shown with the bottle opener attached.
Figure 3:
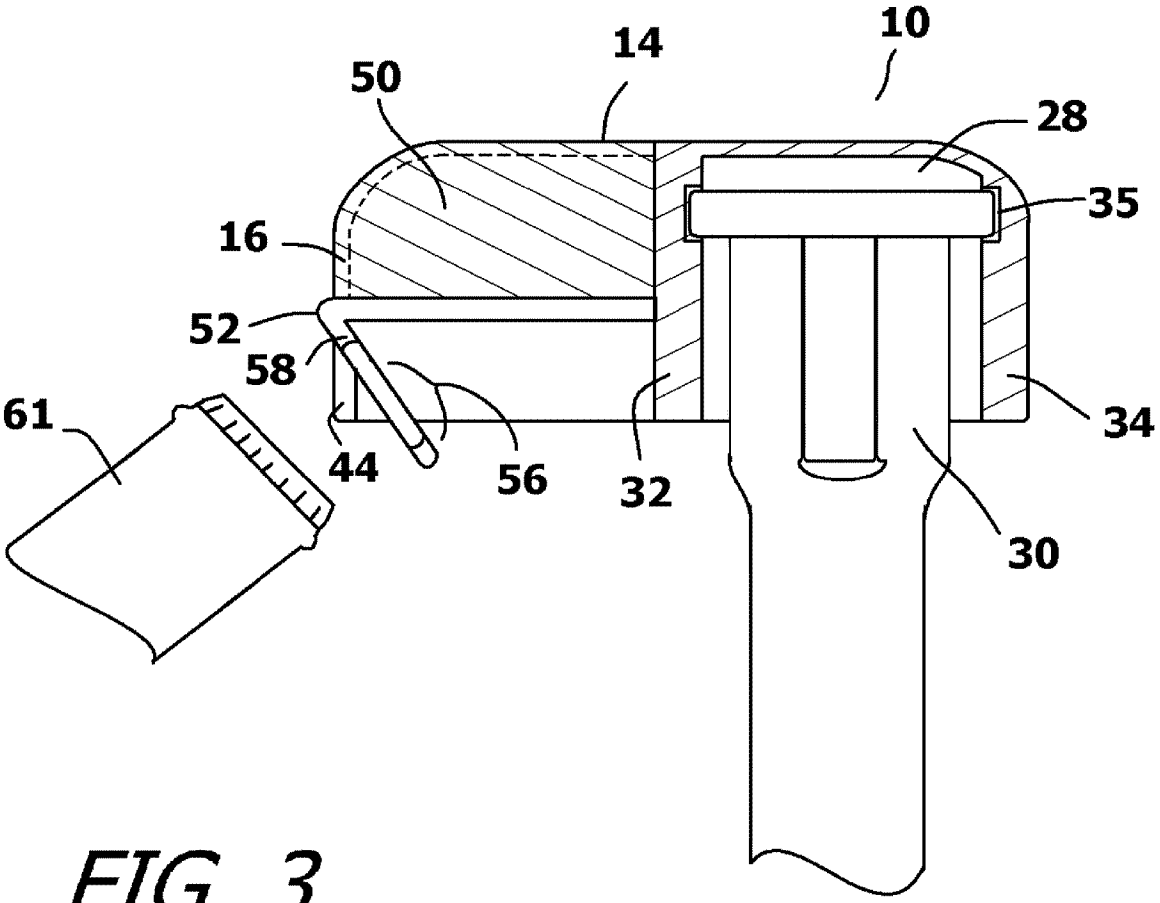
FIG. 3 is a cross-sectional view of the exemplary embodiment of FIG. 2 viewed along section line 3-3.

Referring to FIG. 1 in conjunction with FIG. 2 and FIG. 3, an armrest assembly 10 is shown that can be used on a folding chair 11. The armrest assembly 10 includes a molded plastic body 12. The plastic body 12 has a generally planar top surface 14 and a peripheral side wall 16 that extends downwardly from the edges of the top surface 14. When positioned in an unfolded chair, the top surface 14 of the plastic body 12 is generally positioned in a horizontal and the surfaces of the side wall 16 are generally oriented in the vertical. In use, a person's arm and/or hand rest upon the top surface 14 of the plastic body 12. The top surface 14 is generally smooth and may contain functional depressions 18, such as a cup holder or a phone holder. The top surface 14 may be molded from a same plastic as the plastic body 12. However, in the shown embodiment, the top surface has an overmolded section 17. The overmolded section 17 is made of a softer elastomeric material that is molded onto the plastic body 12. This provides a softer surface that is easier to grip and is more comfortable to rest upon than the material of the plastic body 12.

The plastic body 12 of the armrest assembly 10 has a first end 20 and an opposite second end 22. The first end 20 of the plastic body 12 attaches to the backrest framing 24 of the folding chair 11 at a pivot joint 26. Underneath the plastic body 12 of the armrest assembly 10 is a receptacle 28 that receives the leg junction 30 of the folding chair 11. The receptacle 28 has two parallel reinforced walls 32, 34 that define an interposed slot 36. The slot 36 receives the leg junction 30 of the chair legs 37, 38. The parallel walls 32, 34 contain position adjustment grooves 35 that guide the movement of the leg junction 30 along the length of the slot 36 as the folding chair 11 is opened, closed, and adjusted in position. The walls 32, 34 are molded to be thick and sturdy since they receive and retain the leg junction 30.

The plastic body 12 of the armrest assembly 10 has a first section 40 and a second section 42. During use, the first section 40 is positioned to be primarily contacted by the elbow and forearm of a person sitting in the folding chair 11. The second section 42 is positioned to be primarily contacted by the hand of a person sitting in the folding chair 11. The first section 40 extends from the first end 20 of the plastic body 12 to the distal end of the receptacle 28. The second section 42 extends from the receptacle 28 to the second end 22 of the plastic body 12. Accordingly, the receptacle 28 and the walls 32, 34 of the receptacle 28 are in the first section 40 of the plastic body 12 where they are unlikely to be contacted by the hands or fingers as the folding chair 11 is being opened and adjusted in position.

The side wall 16 of the plastic body 12 extends around the periphery of the plastic body 12 in all areas but one. An opening 44 is formed in the side wall 16 in a position adjacent to the receptacle 28. The opening exists between two parallel wall edges 46, 48. The remaining length of the side wall 16 is solid.

The plastic body 12 of the armrest assembly 10 is not solid within the confines of the side wall 16. Rather, the plastic body 12 is mostly hollow. Consequently, the plastic body 12 of the armrest 10 does not have a bottom surface. Rather, below the top surface 14 is a complex underside 15. The underside 15 is a honeycombed structure with a series of molded reinforcement ribs 50 within the confines of the side wall 16. The honeycombed structure of the underside 15 provides structural integrity and strength to the plastic body 12.

A bottle opener 52 is provided. The bottle opener 52 has a base plate 54 that extends in a first plane and a head section 56 that extends in a plane acute to the first plane of the base plate 54. The head section 56 is attached to the base plate 54 with a curved neck 58. The base plate 54 of the bottle opener 52 is attached to the reinforcement ribs 50 on the underside 15 of the plastic body 12. The base plate 54 is positioned between the opening 44 in the side wall 16 and the first wall 32 of the receptacle 28. The base plate 54 abuts against the first wall 32 of the receptacle 28. Accordingly, any lateral force or torsion force applied to the bottle opener 52 by a bottle 61 will be transferred both to the reinforcement ribs 50 and to the first wall 32 of the receptacle 28. As previously stated, the walls 32, 34 of the receptacle 28 are thick and strong so they can handle the forces transferred through the leg junction 30 from the legs 37, 38 of the folding chair 11. The presence of the wall 32 also shortens the length of the reinforcement ribs 50 to which the base plate 54 attaches. This, in turn, makes the reinforcement ribs 50 more rigid and capable of withstanding significant torsion forces that may be applied during the opening of a bottle 61.

The curved neck 58 of the bottle opener 52 holds the head section 56 of the bottle opener 52 at one or more angles of inclination with respect to both the vertical plane and the horizontal plane. The head section 56 of the bottle opener 52 is aligned with the opening 44 in the side wall 16 of the plastic body 12. The opening 44 is positioned on the seat side of the armrest assembly 10. That is, the opening 44 faces a person seated in the folding chair 11. In such a position, it will be understood that the thumb of a person's hand would be the closest appendage to the bottle opener 52. The inclined angle of the head section 56 ensures that the thumb will not inadvertently contact the head section 56 where it could get caught.

In FIG. 1 through FIG. 3, the bottle opener 52 is shown applied to a left side armrest. It should be understood that the present invention can likewise be applied to a right side armrest. Such an embodiment is presented in the embodiment of FIG. 4 and FIG. 5.

Figure 4:
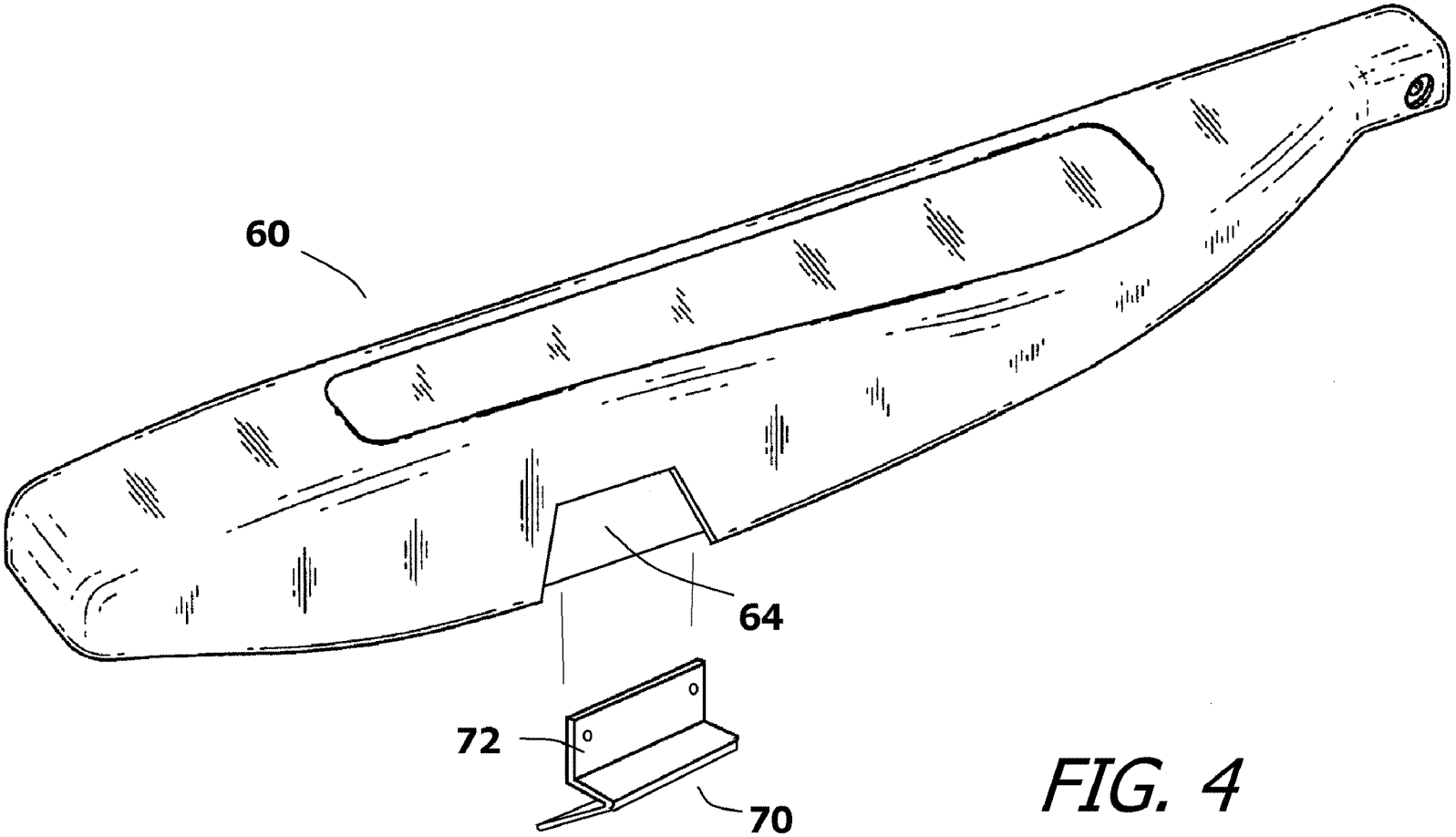
FIG. 4 is a perspective view of a second exemplary embodiment of an armrest assembly with the bottle opener shown detached.
Figure 5:
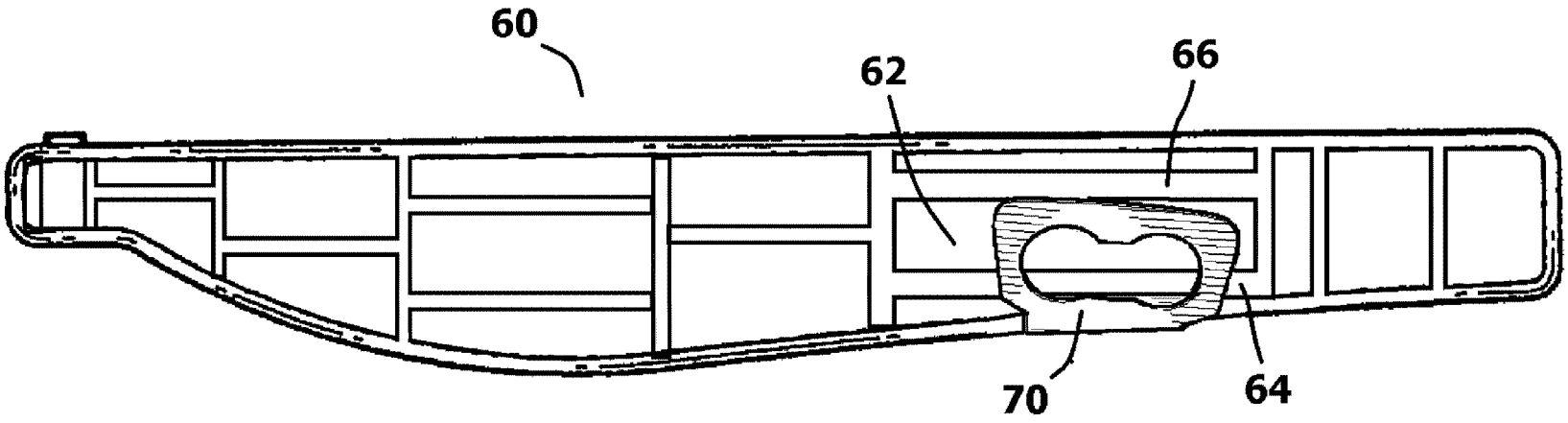
FIG. 5 is a bottom view of the exemplary embodiment of the armrest assembly of FIG. 4 shown with the bottle opener attached.

Referring to FIG. 4 and FIG. 5, an armrest assembly 60 is shown that contains a receptacle 62 for a leg junction at a more centralized location. The receptacle 62 has parallel walls 64, 66 that guide the movement of the leg junction. However, the room between the walls 64, 66 and the periphery of the armrest body 68 is limited. This provides only a small area for the installation of a bottle opener 70. The bottle opener 70 has a base plate 72. To better secure the bottle opener 70, the base plate 72 of the bottle opener 70 is L-shaped, rather than flat. This enables the base plate 72 to attach to both the reinforcement ribs next to the receptacle 62 and to the exterior of the receptacle wall 64. In this manner, much of the forces experienced by the bottle opener 70 are transferred directly to the wall 64 of the receptacle 62, which is sturdy enough to bear those forces without damage.

It will be understood that the embodiments of the present invention that are illustrated and described are merely exemplary and that a person skilled in the art can make many variations to those embodiments. For instance, the present invention can be adapted to most any plastic armrest used on folding or collapsible chairs. All such embodiments are intended to be included within the scope of the present invention as defined by the claims.

What is claimed is:

1. An armrest assembly for a folding chair, comprising:

a molded plastic body having a top surface, wherein said top surface has an underside reinforced by support ribs;

a leg joint receptacle having two parallel walls formed on said underside of said molded plastic body; and a bottle opener having a base and a head section that extends from said base, wherein said base is mounted to said underside of said molded plastic body and wherein said base directly contacts said leg joint receptacle;

wherein said top surface has a periphery, wherein a peripheral wall extends from said periphery and is generally perpendicular to said top surface; and wherein an opening is formed in said peripheral wall, wherein said bottle opener is mounted to said molded plastic body between said opening and said leg joint receptacle, wherein said bottle opener is accessible through said opening.

2. The assembly according to claim 1, wherein said base of said bottle opener abuts against one of said parallel walls of said leg joint receptacle.

3. The assembly according tom claim 1, wherein said base of said bottle opener mounts to one of said parallel walls of said leg joint receptacle.

4. The assembly according to claim 1, wherein said base of said bottle opener is planar and said head section of said bottle opener has at least one angle of inclination relative said base.

5. The assembly according to claim 1, wherein said molded plastic body has a seat side surface that faces toward a seat of a folding chair, wherein said opening is disposed in said peripheral wall along said seat side surface.

6. The assembly according to claim 1, wherein said molded plastic body has a first end and an opposite second end, wherein said molded plastic body has a backrest pivot joint proximate said first end.

7. An armrest assembly for a folding chair, comprising:

a molded plastic top surface having an underside reinforced by support ribs;

a leg joint receptacle having two parallel walls formed on said underside of said molded plastic body; and a bottle opener having a base and a head section that extends from said base, wherein said base is mounted to said underside of said molded plastic top surface;

wherein said top surface has a periphery, wherein a peripheral wall extends from said periphery and is generally perpendicular to said top surface; and wherein an opening is formed in said peripheral wall, wherein said bottle opener is mounted to said molded plastic body between said opening and said leg joint receptacle, wherein said bottle opener is accessible through said opening.

8. The assembly according to claim 7, wherein said bottle opener is mounted to said underside adjacent said opening.

9. The assembly according to claim 8, wherein said peripheral wall has a seat-side surface that faces toward a seat of a folding chair, wherein said opening is disposed in said peripheral wall along said seat-side surface.

10. The assembly according to claim 9, wherein a first wall of said two parallel walls is affixed to at least some of said support ribs.

11. The assembly according to claim 10, wherein said base of said bottle opener abuts against said first wall of said leg joint receptacle.

12. The assembly according to claim 10, wherein said base of said bottle opener mounts to said first wall of said leg joint receptacle.

13. The assembly according to claim 7, wherein said base of said bottle opener is planar and said head section of said bottle opener has at least one angle of inclination relative said base.

* * * * *